US007549468B2

(12) United States Patent
Pleskie

(10) Patent No.: US 7,549,468 B2
(45) Date of Patent: Jun. 23, 2009

(54) COILED TUBING INJECTOR SYSTEM

(75) Inventor: Allan J. Pleskie, Chestermere (CA)

(73) Assignee: Foremost Industries Ltd., Calgary, Alberta (CA)

( * ) Notice: Subject to any disclaimer, the term of this patent is extended or adjusted under 35 U.S.C. 154(b) by 20 days.

(21) Appl. No.: 11/637,153

(22) Filed: Dec. 12, 2006

(65) Prior Publication Data

US 2007/0131432 A1 Jun. 14, 2007

(30) Foreign Application Priority Data

Dec. 13, 2005 (CA) ..... 2529921

(51) Int. Cl.
*E21B 19/22* (2006.01)

(52) U.S. Cl. ..... 166/77.2; 166/384

(58) Field of Classification Search ..... 166/77.2, 166/384

See application file for complete search history.

(56) References Cited

U.S. PATENT DOCUMENTS

| | | | | |
|---|---|---|---|---|
| 3,559,905 | A | 2/1971 | Palynchuck | |
| 3,658,270 | A | 4/1972 | Slator | |
| 3,690,136 | A | 9/1972 | Slator | |
| 3,841,407 | A | 10/1974 | Bozeman | |
| 4,040,524 | A | 8/1977 | Lamb et al. | |
| 4,249,600 | A | 2/1981 | Bailey | |
| 4,265,304 | A | 5/1981 | Baugh | |
| 4,290,495 | A * | 9/1981 | Elliston | 175/85 |
| 4,336,840 | A | 6/1982 | Bailey | |
| 4,570,705 | A | 2/1986 | Walling | |
| 4,585,061 | A | 4/1986 | Lyons | |
| 4,612,984 | A | 9/1986 | Crawford | |
| 4,673,035 | A | 6/1987 | Gipson | |
| 4,682,657 | A | 7/1987 | Crawford | |
| 5,029,642 | A | 7/1991 | Crawford | |
| 5,289,845 | A | 3/1994 | Sipos | |

(Continued)

FOREIGN PATENT DOCUMENTS

| | | |
|---|---|---|
| CA | 2235555 C | 7/1999 |

(Continued)

OTHER PUBLICATIONS

Bell, Steven S., "Bridging gap between conventional and coiled tubing rings", World Oil, Jun. 1997, p. 23, vol. 218(6).

(Continued)

*Primary Examiner*—Giovanna C Wright
(74) *Attorney, Agent, or Firm*—Miles & Stockbridge P.C.; David R. Schaffer, Esq.

(57) ABSTRACT

A coiled tubing injector system which includes transport trailer components for separate transfer to and from a drilling site. Each component is taken to the site with its own transport tractor, a first component including a coil storage reel and a second component including a tubing injector carried on a mast which is raised from a horizontal transport position, through a stabbing and unstabbing position to a raised working position. When the components are arranged together in an end-to-end with the mast in a stabbing position, a tube gripping member is positioned between the storage reel and tubing injector for controlling the handling of a free end of the stored tubing for stabbing and unstabbing of the tubing injector.

9 Claims, 4 Drawing Sheets

U.S. PATENT DOCUMENTS

| | | | | |
|---|---|---|---|---|
| 5,411,085 | A | 5/1995 | Moore | |
| 5,435,395 | A | 7/1995 | Connell | |
| 5,439,066 | A | 8/1995 | Gipson | |
| 5,638,904 | A | 6/1997 | Misselbrook | |
| 5,660,235 | A | 8/1997 | Sola | |
| 5,738,173 | A | 4/1998 | Burge | |
| 5,823,267 | A | 10/1998 | Burge | |
| 5,839,514 | A | 11/1998 | Gipson | |
| 5,842,530 | A | 12/1998 | Smith | |
| 5,865,392 | A | 2/1999 | Blount | |
| 5,875,850 | A | 3/1999 | Burge | |
| 5,937,943 | A | 8/1999 | Butler | |
| 6,003,598 | A | 12/1999 | Andreychuk | |
| 6,015,015 | A | 1/2000 | Luft | |
| 6,032,744 | A | 3/2000 | Burge | |
| 6,065,540 | A | 5/2000 | Thomeer | |
| 6,092,756 | A | 7/2000 | Sola | |
| 6,158,516 | A | 12/2000 | Smith et al. | |
| 6,273,188 | B1 | 8/2001 | McCafferty | |
| 6,283,211 | B1 | 9/2001 | Vloedman | |
| 6,332,501 | B1 | 12/2001 | Gipson | |
| 6,371,505 | B1 | 4/2002 | Turner, II | |
| 6,431,286 | B1 | 8/2002 | Andreychuk | |
| 6,457,534 | B1 | 10/2002 | Rolovic et al. | |
| 6,494,397 | B1 | 12/2002 | Myklebust | |
| 6,497,290 | B1 | 12/2002 | Misselbrook | |
| 6,502,641 | B1 | 1/2003 | Carriere et al. | |
| 6,609,565 | B1 | 8/2003 | Andreychuk | |
| 6,702,011 | B2 | 3/2004 | Crawford et al. | |
| 6,767,172 | B2 | 7/2004 | French | |
| 7,028,781 | B2 | 4/2006 | Hill | |
| 7,111,689 | B2 | 9/2006 | Wise et al. | |
| 7,152,672 | B1 | 12/2006 | Gipson | |
| 2001/0015274 | A1 | 8/2001 | Gipson | |
| 2002/0000332 | A1 | 1/2002 | Merecka | |
| 2002/0020562 | A1 | 2/2002 | Baird | |
| 2002/0070033 | A1 | 6/2002 | Headworth | |
| 2002/0079108 | A1 | 6/2002 | Headworth | |
| 2002/0125014 | A1 | 9/2002 | Dearing | |
| 2003/0010505 | A1 | 1/2003 | Gipson | |
| 2003/0079883 | A1 | 5/2003 | McCulloch | |
| 2003/0098150 | A1 | 5/2003 | Andreychuk | |
| 2003/0196797 | A1 | 10/2003 | Crawford | |
| 2003/0226667 | A1* | 12/2003 | Hill | 166/384 |
| 2004/0007391 | A1 | 1/2004 | Baird | |
| 2004/0140093 | A1 | 7/2004 | Vloedman | |
| 2004/0159440 | A1 | 8/2004 | Heinonen | |
| 2004/0159441 | A1 | 8/2004 | Heinonen | |
| 2004/0188088 | A1 | 9/2004 | Newman | |
| 2004/0206551 | A1 | 10/2004 | Carriere | |
| 2004/0211598 | A1 | 10/2004 | Palidis | |
| 2004/0240973 | A1 | 12/2004 | Andrew | |
| 2004/0244993 | A1 | 12/2004 | Crawford | |
| 2005/0023404 | A1 | 2/2005 | Hill | |
| 2005/0051344 | A1 | 3/2005 | Goss | |
| 2005/0082064 | A1 | 4/2005 | Foster | |
| 2005/0093340 | A1 | 5/2005 | Cain | |
| 2005/0193645 | A1 | 9/2005 | Barnes | |
| 2005/0194189 | A1 | 9/2005 | Barnes | |
| 2005/0247456 | A1 | 11/2005 | Wise | |
| 2006/0000619 | A1 | 1/2006 | Borst | |
| 2006/0027373 | A1 | 2/2006 | Carriere | |
| 2006/0207767 | A1 | 9/2006 | Andreychuk | |
| 2006/0231267 | A1 | 10/2006 | Wood | |
| 2006/0231268 | A1 | 10/2006 | Wood | |
| 2006/0231269 | A1 | 10/2006 | Wood | |
| 2006/0254781 | A1 | 11/2006 | Hill | |
| 2006/0283587 | A1* | 12/2006 | Wood et al. | 166/77.2 |
| 2006/0283588 | A1* | 12/2006 | Wood et al. | 166/77.2 |
| 2006/0283605 | A1* | 12/2006 | Wood et al. | 166/380 |
| 2006/0289170 | A1 | 12/2006 | Wood | |
| 2006/0289171 | A1 | 12/2006 | Wood | |
| 2007/0029090 | A1 | 2/2007 | Andreychuk | |
| 2007/0095525 | A1 | 5/2007 | Austbo | |
| 2007/0114041 | A1 | 5/2007 | Wood | |
| 2007/0125549 | A1 | 6/2007 | Wood | |
| 2007/0125551 | A1 | 6/2007 | Havinga | |
| 2007/0125552 | A1 | 6/2007 | Wood | |
| 2007/0131432 | A1 | 6/2007 | Pleskie | |
| 2007/0144745 | A1 | 6/2007 | Carriere | |
| 2007/0175642 | A1 | 8/2007 | Shampine | |
| 2007/0194164 | A1 | 8/2007 | Saheta | |
| 2007/0209791 | A1 | 9/2007 | Havinga | |
| 2007/0215359 | A1 | 9/2007 | Wood | |
| 2007/0221386 | A1 | 9/2007 | Rock | |

FOREIGN PATENT DOCUMENTS

| | | | |
|---|---|---|---|
| CA | 2298089 | A1 | 8/2001 |
| CA | 2332290 | A1 | 8/2001 |
| CA | 2322916 | A1 | 4/2002 |
| CA | 2322917 | A1 | 4/2002 |
| CA | 2384214 | A1 | 1/2003 |
| CA | 2364147 | A1 | 5/2003 |
| CA | 2488106 | A1 | 12/2003 |
| CA | 2425448 | A1 | 8/2004 |
| CA | 2502982 | A1 | 11/2005 |

OTHER PUBLICATIONS

BJ Services Co. and Philips Petroleum Co., "Coiled tubing drilling tower improves safety, flexibility", World Oil, Apr. 2001, p. E-6, vol. 222(4).

Callaway, Tim, "Impressive Newcomer sets the pace", Alberta Report, Jun. 2001, pp. 1-10.

Coats, E.A. and Farabee, Mark, "Drilling system combines composite-coiled tubing, hydraulic-workover unit", Oil & Gas Journal, Apr. 2002, pp. 55-60, vol. 100(16).

Gaddy, Dean E., "Coiled-tubing drilling technologies target niche markets", Oil & Gas Journal, Jan. 2000, pp. 29-34, vol. 98(2).

Gary, S.C., "Coiled tubing drilling requires economic and technical analyses", Oil & Gas Journal, Feb. 1995, pp. 59-62, vol. 93(8).

Hartley, Frank, "Underbalanced drilling with coiled tubing proves safe, efficient", Offshore, May 2004, p. 50, vol. 64(5).

Hartley, Frank, "MRI measurement includes analysis of reservoir fluids", Offshore, Mar. 2001, vol. 61(3).

Hightower, C.M., "Operator's coiled tubing drilling program gets good results", World Oil, Oct. 1997, pp. 77-80, vol. 210(10).

Hope, Philip, "Houston bags a big one: but the fight for Fracmaster means the Canadian oilpatch is recovering", Alberta Report, Jun. 1999, pp. 16-17, vol. 26(25).

Larson, Eric et al., "Hybrid rig development aids North Slope coiled tubing operations", World Oil, Aug. 1997, pp. 189-190, vol. 218(8).

Lord, David, "Shell Expro's first application of coiled tubing drilling", World Oil, Jun. 1997, pp. 119-123, vol. 218(6).

Rixse, Mel and Johnson, Mark O., "High performance coil-tubing drilling develops shallow North Slope heavy oil", Oil & Gas Journal, Jul. 2002, pp. 58-63, vol. 100(27).

Snyder, Robert E., "Lessons learned in major underbalanced sidetrack drilling project", World Oil, Mar. 2005, pp. 29-34, vol. 226(3).

Snyder, Robert E., "US firms could follow Canada's lead in coiled tubing drilling", World Oil, Feb. 2005, pp. 85-86, vol. 226(2).

"Coiled Tubing Technical Advances Cut Operational Costs Sharply", Drilling Contractor, Jul./Aug. 2005, pp. 36-41.

Ensign Brochure in Canada Newswire dated May 12, 2005.

Fracmaster/Nowsco CTD Rigs (Copyright 2001 - CTES, L.C.).

http://hydrarig.com/PDF/Brochures/Coiled_Tubing/Coiled_Tubing _Systems.pdf.

Pages from www.ensignenergy.com/adr/info.html.

Protest filed in CA2547167 on May 28, 2007.

Protest filed in CA2547167 on Feb. 12, 2008.

Series of pictures taken on May 18, 2005 in Downtown Calgary, Alberta of Ensign Coiled Tubing Rig.

U.S. Appl. No. 11/300,842, Form PTO-A820, filed by Applicants on Jun. 16, 2008 and considered by Examiner Robert Fuller on Aug. 20, 2008, 2 pages (documents listed are not available in PAIR).

CD with animation of Ensign ADR.

Ensign Champion Drilling - #53 - specification - Dec. 13, 2005.

Pages from http://www.ensignenergy.com/adr/info.html - Ensign RigFinder - Details of Champion ADR.

* cited by examiner

COILED TUBING INJECTOR SYSTEM

CROSS REFERENCE TO RELATED APPLICATION

This invention claims the benefit of convention priority of Canadian Patent Application No. 2,529,921, filed Dec. 13, 2005, entitled COILED TUBING INJECTOR SYSTEM, the disclosures of which are incorporated herein in the entireties.

FIELD OF THE INVENTION

This invention relates to a coiled tubing injector system transportable on trailers for set up in different locations for well drilling.

BACKGROUND OF THE INVENTION

Over the last couple of decades, the technique of drilling wells, particularly those relating to oil and gas production, by way of injection and withdrawal of a length of continuous tubing, instead of the earlier process of drilling with jointed drill pipe, has been continuously developing. The two different techniques are in fact commonly used alternatively in the drilling of a single hole, and there exists hybrid drilling rigs equipped to alternatively handle both conventional jointed pipe and flexible coiled tubing. During the early development years of coiled tubing technology, it was common for the injector component of the system and the tubing reel to be separately trucked to a well site, and at which time the injector component was mounted and attached to the well head and the tubing reel located nearby with the tubing to be fed into the mounted injector. During further development of this technology, systems were used wherein both the tubing reel and a boom structure for handling the injector were mounted on separate wailers on which they remained during the well drilling process. Examples of such equipment are shown as prior art in U.S. Pat. No. 7,028,781 of Hill and U.S. Pat. No. 7,111,689 of Wise et al. However, for the sake of convenience and efficiency in set-up and operation more current designs of equipment are based on single load, one truck design, which has the advantage of the coil tubing remaining stabbed or installed in the injector between rigging down the coiled tubing injector operation at one site and then rigging it up again at a new site, thus reducing the down time. However, such known designs have a significant disadvantage as related technology has developed to the stage that much deeper drilling is possible and indeed desirable in many situations, but the depth available with known rigs is limited by the length of coil available in the reel. The reel size, on the other hand, is in turn determined as to what total size and weight of a trailer is possible for movement over roadways. At present such rigs include coiled tubing storage reels which are at a maximum capacity in this regard.

SUMMARY OF THE INVENTION

It is an object of the invention to provide a coiled tubing injector system which may be transported to a drilling site for drilling deeper wells than is presently possible and capable of being rigged up or rigged down in an acceptable period of time.

It is further an object of the invention to provide a coil injector system wherein separate trailer components are provided to separately transport the tubing storage reel and the mast and injector components to a well site and wherein the components are combined to provide an operational site having the operating characteristics and advantages similar to those of more recently developed single load type.

According to one aspect of the present invention, there is provided a coiled tubing injector system including first and second transport trailer components, each having a load supporting deck providing a forward section including a connector means for independent attachment to fifth wheels of separate tractor units so as to provide separate loads from one site to another. The first transport trailer component includes an intermediate section contiguous with the forward section and providing support means for a tubing storage reel, and a rearward section contiguous with the intermediate section thereof for joining with the forward section with the forward section of the second transport trailer component. The second transport trailer component includes an intermediate section contiguous with the forward section thereof and a rearward section contiguous with its intermediate section. The rearward section of the second transport component has mounted thereon a mast carrying a tube injector, the mast having a pivotal connection with the rearward section of the second transport trailer component for movement of the mast between a vertical position and a substantially horizontal position overlying the intermediate and forward sections of the second transport trailer component. Accordingly, on aligning the forward section of the second transport trailer component to the rear section of the first trailer component at a drill site, a continuous coiled tubing injector rig is provided.

More specifically, the forward section and the intermediate section of the first transport trailer component form a raised portion of the first transport trailer component in relation to a lowered portion thereof forming the rearward section of the first transport wailer component. The forward section of the second transport trailer component is formed by a raised portion thereof in relation to the intermediate and rearward sections thereof. Thus, the forward section of the second transport trailer component overlies the rearward section of the first transport trailer component when the components are in an operating relationship.

In a preferred embodiment of the coiled tubing injector system, there is provided a gripper box carried on the supporting deck of the first transport trailer component rearwardly of the support means for the tubing storage reel and positioned to hold a free end of coiled tubing stored on the tubing storage reel.

More specifically, the gripper box is attached to the first transport trailer component by a control arm for locating the gripper box above the load supporting deck of the first transport trailer component. This control arm may include a double acting hydraulic cylinder controllable for locating the free end of the coiled tubing in a desired position relative to the load supporting deck.

In a specific form of the present invention, the control arm is pivotally connected at a lower end thereof to the first transport trailer component, and also has a second double acting hydraulic cylinder connected between the control arm and the first transport trailer component, this second cylinder also being controllable for establishing the angle of pivot between the control arm and the first transport trailer component.

Yet another aspect of the invention resides in a method of feeding a coiled tubing into and out of a well at a well-head site, including the steps of moving separate first and second transport trailer components to the site. In this aspect of the invention, the transport trailer components each have a rear portion and a forward portion for overlying and attachment to a fifth wheel of a tractor unit. The first transport component further has an intermediate portion carrying a motor driven tubing storage reel for rotation about a transverse axis, and a gripping member rearwardly of the tubing storage reel for holding a free end of the tubing on the reel. The second transport component has a mast carrying a tube injector mounted on the rear end portion thereof. The mast is pivotally connected to the second transport component and includes motor means for raising and lowering the mast between a lowered transport mode overlying the second transport component in the transport mode and an upright operational mode. In this method a process is included which involves the positioning of the second transport component in a location with a rear portion over the well head site, and then backing the first transport component into alignment with the forward end portion of the positioned second transport component with the rear portion of the first transport component juxtaposed the forward portion of the second transport component so as to form substantially continuous aligned upper decks of the first and second transport components. The gripping member on the first transport component is then released to allow the free end of the stored coiled tubing to pass from the storage reel and to be drawn over a goose-neck of the injector by initially energizing the injector. The mast is then raised to a fully upright operating position, and a drilling operation commenced while continuing to feed the tubing from the reel and through the injector and into the well.

More specifically the process may further include the steps of attaching to the free end of the stored coiled tubing a rear end of a snake member, prior to releasing the gripping member. A forward end of the snake member is at least partially passed through the injector, and the injector further operated after the releasing of the gripping member to draw the snake member completely through the injector so that the free end of the stored coiled tubing is pulled over the gooseneck and enters the injector. The snake member is then disconnected and removed from the free end of the coiled tubing.

The process may further include the following steps after completion of the drilling operation: withdrawing the tubing from the drilled well by reverse operation of the injector and recoiling the tubing on the storage reel lowering the boom, clamping the free end of the coiled tubing by the gripping member, and removing the first transport component from the site, and then separately moving the second transport component from the site.

The process more specifically includes the steps of terminating operations of the injector and the recoiling by the storage reel when the free end of the tubing leaves the well and before entering the injector, and thereafter attaching to the free end of the tubing a forward end of the snake member; reactivating the operation of the injector and the storage reel to continue rewinding the tubing until the free end of the tubing approaches the clamping member; reactivating the gripping member to hold the free end of the tubing; and disconnecting the snake member from the free end of the tubing prior to separately removing the first and second transport components from the site.

DETAILED DESCRIPTION OF THE INVENTION

Figure 1:
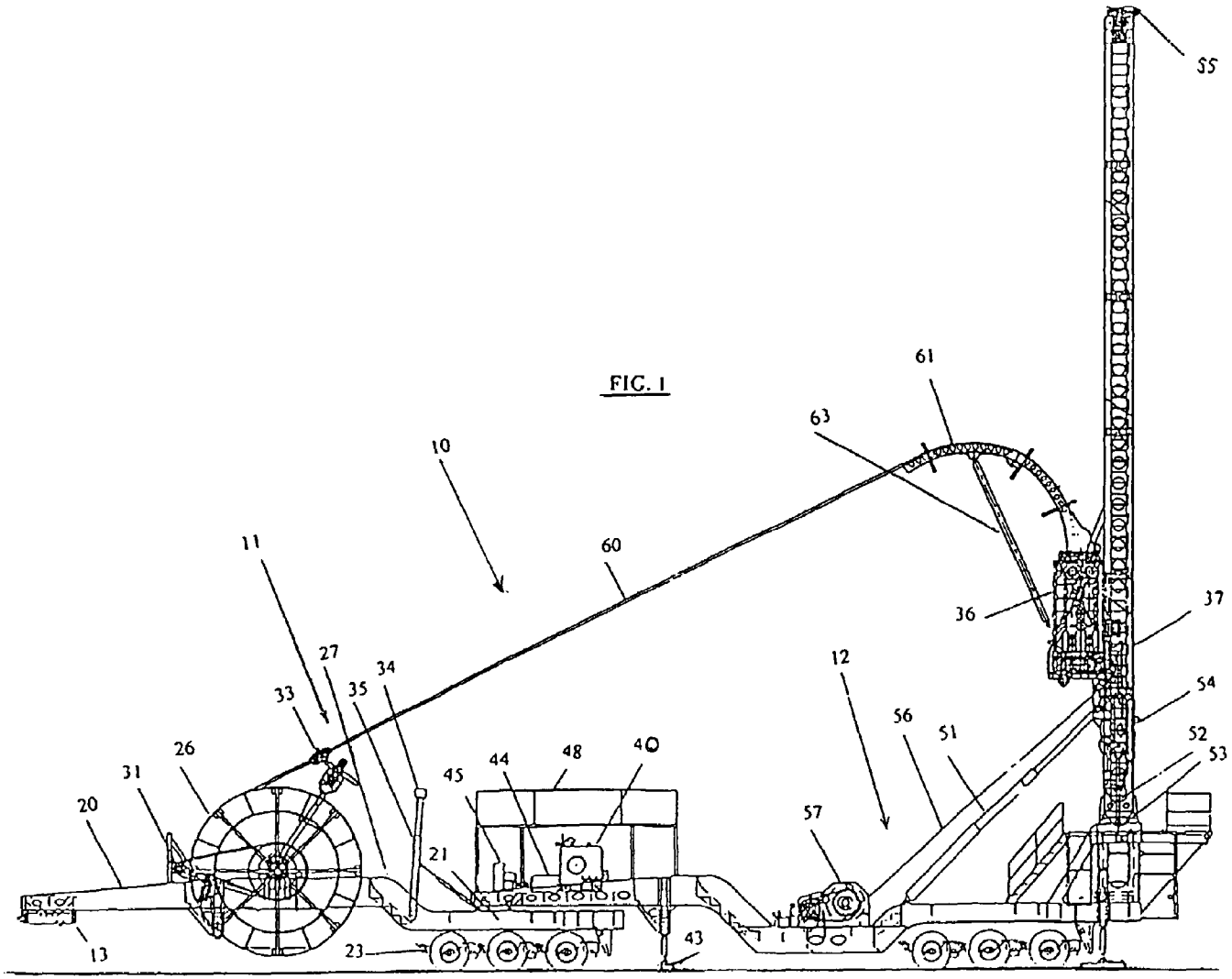
FIG. 1 is a side elevational view of the coiled tubing injector system of the present invention in a working mode.
Figure 2:
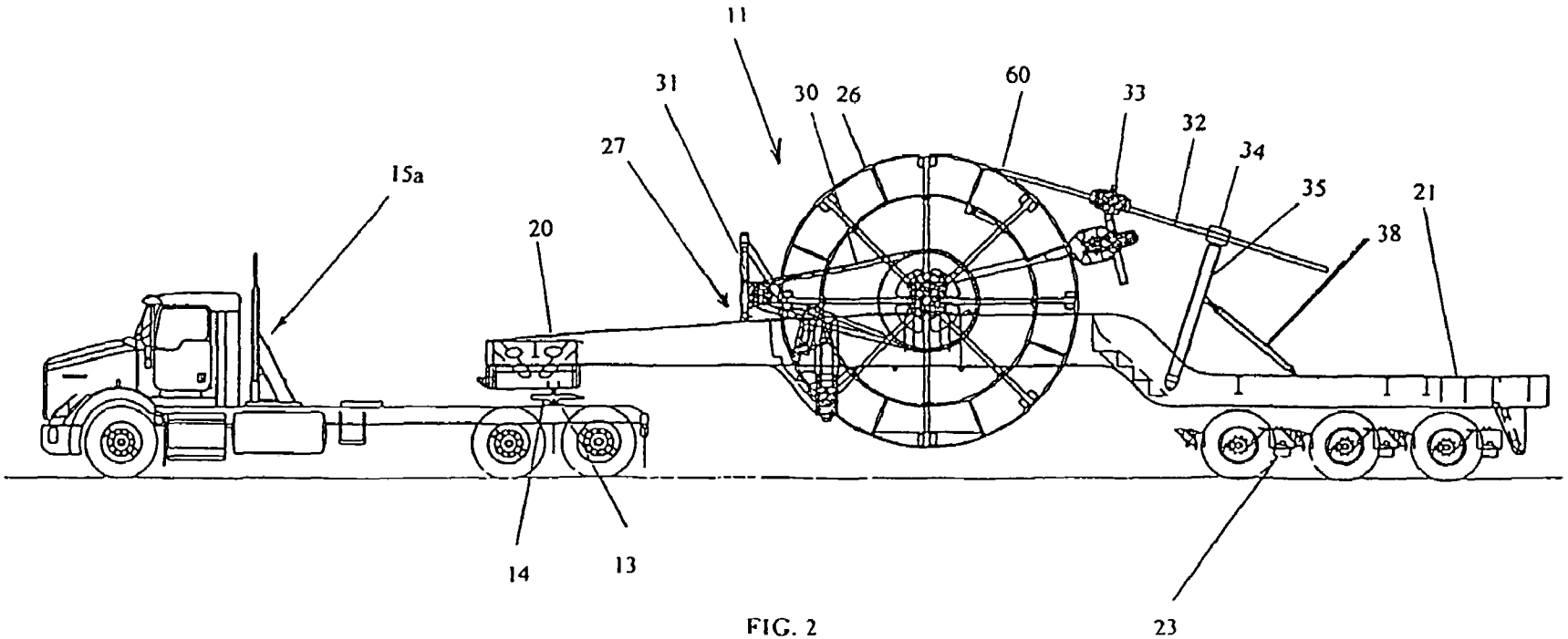
FIG. 2 is a side elevation view showing a first transport trailer component of the present invention on which the coiled tubing reel is mounted.

An assembled form of a coiled tubing injector system 10 of the present invention is shown in FIG. 1, wherein a first transport trailer component 11 has a rearward section 21 thereof in joined relation to a second transport trailer component 12. The first transport trailer component 11 is shown in FIG. 2 in a transport mode, having a conventional connector means 13 for interconnection with a fifth wheel 14 of a first transport tractor 15*a*. The second transport trailer component 12 is shown in FIG. 3 in a transport mode having a conventional connector means 16 interconnected with a fifth wheel 17 of another transport trailer 15*b*.

The first transport trailer component 11 has a forward section 20 (FIG. 2), which is at a raised level relative to the rearward section 21. The forward section 20 of the first transport trailer component 11 may be provided with an outrigger or the like (not shown) for support when this component is standing alone. The connector means 13 is located within this forward section 20 which is located at a height under which the tractor fifth wheel 14 may be backed for connection for towing of the first transport trailer 11 from one site to another. The rearward section 21 of the first transport trailer 11 is supported by a wheeled support undercarriage 23 and is at a lower level than the forward section 20, so that the upper surface of the rearward section 21 is at a level to receive thereover a forward section 24 of the second transport trailer component (FIG. 1). The forward section 20 of the first transport trailer component is preferably provided with outriggers (not shown) for support when separated from the transport tractor 15*a*.

Located behind the forward portion 20 of the first transport trailer component 11, and at the same level, is an intermediate section which includes mounting means for tubing storage reel 26. The mounting means are secured on top of a pair of spaced side rails of the intermediate section in order that the tubing storage reel 26 occupies the space between the rails and the lowermost circumference of the reel is well below the raised intermediate section 20 of the first transport trailer component 11. The reel 26 is journalled by way of its mounting means for rotation and such rotation is controlled by way of a drive means system 30 including a hydraulically driven motor 31. Prior to a stabbing procedure which will be described in more detail below, the coiled tubing 60 wound in the storage reel has a free end 32 which extends through a level wind device 33 carried by the framework of the intermediate section 27 of the first transport trailer component 11. The free end is further secured by a gripper box 34 affixed to the frame of the first transport trailer 11 by a control arm 35. The control arm 35 includes a double acting cylinder, the extending and contracting of which is controllable by an appropriate valve means (not shown) so as to position the gripper box at a desired distance from the deck of the first transport trailer component, and as described in more detail, its position relative to a tube injector 36 mounted on mast 37 carried on the second transport trailer component 12, when the two components 11 and 12 are joined. The control arm 35 is pivotally connected at its lower end to the rear of the intermediate section 27 of the first transport trailer component 11, and is connected from a mid section thereof to a framework of the first transport trailer component 11 by a double acting cylinder strut 38, whereby the angle of the control arm 35 can be varied as well.

Figure 3:
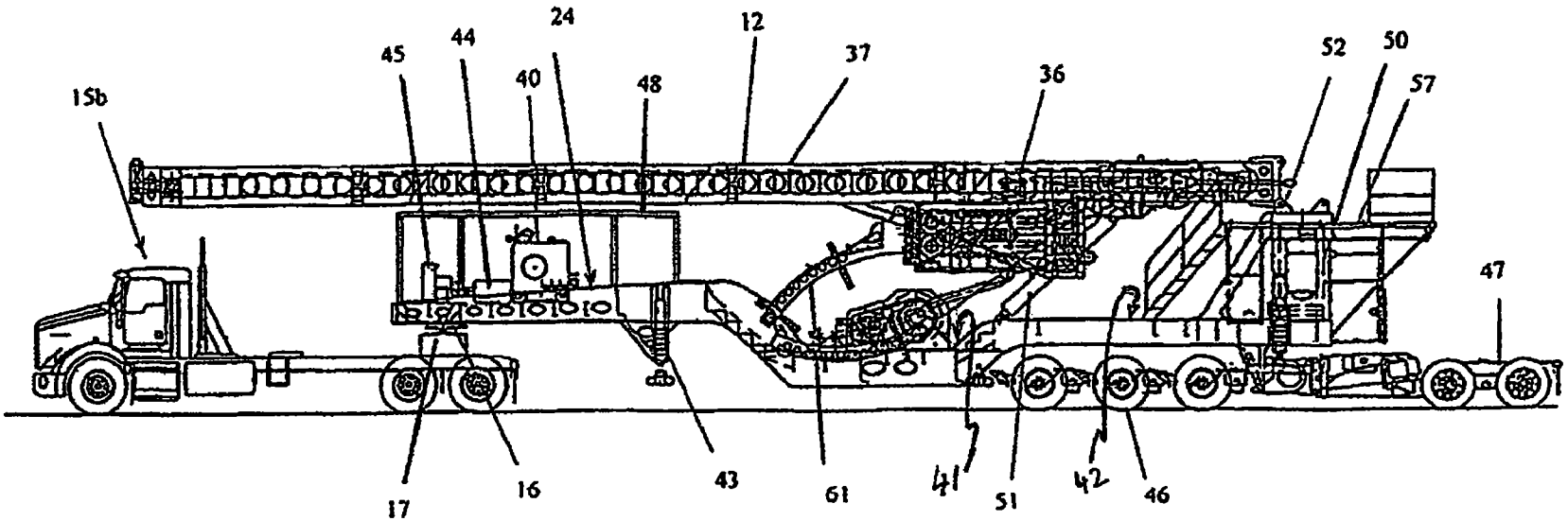
FIG. 3 is a side elevational view showing a second transport trailer component of the present invention on which the mast and injector head are carried.
Figure 4:
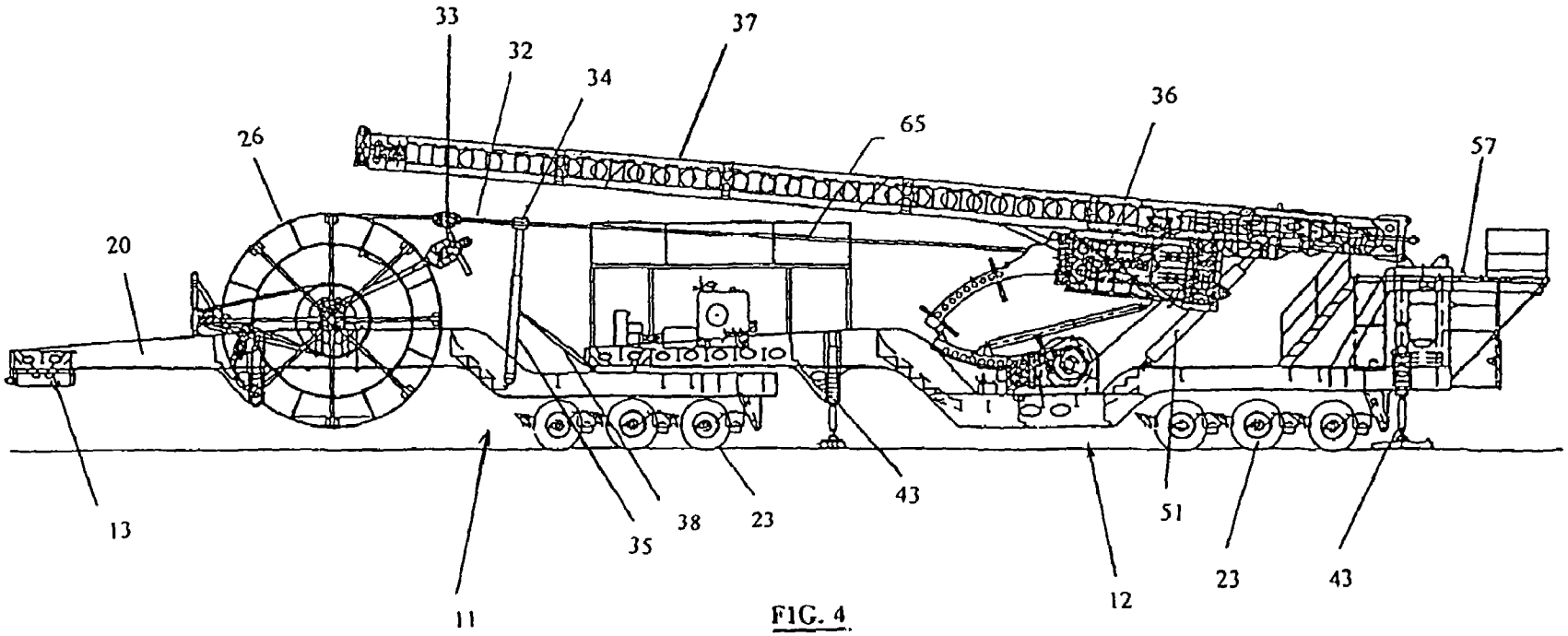
FIG. 4 is a side elevational view on a reduced scale of the combined components of FIGS. 3 and 4, located together to form the coiled tubing injector system of the present invention with the mast raised to an initial stabbing mode prior to being raised to the working mode shown in FIG. 1.

The second transport trailer component 12, as shown in FIG. 3, includes a continuous framework forming a forward section 24, and intermediate section 41, and a rearward section 42. The forward section 24 is raised relative to the other sections 41,42, and, as shown, has provided at a forward end thereof the fifth wheel connector means 16 to provide attachment of the second transport trailer component 12 to the transport tractor 15*b* for travel to and from each drill hole site independent of the first transport trailer component 11. The forward section 41 is provided with outriggers 43 for supporting the forward end of the second transport component 15*b* separate from the tractor, and to allow the rearward section of the first transport trailer component 11 to be backed into a position where the front of the forward section 24 overlies the rearward section 21 as shown in FIGS. 1 and 4. There is supported on the forward section 24 of the second transport trailer component 12 an electric motor and pump unit 44, a hydraulic oil cooler 45 and an hydraulic tank 40, the output of the pump being connected to the various controls relating to the hydraulically driven items on the two transport trailer components of the overall system when connected. Also mounted on the forward section 24 and located above the just mentioned system for supplying pressurized hydraulic fluid, is a stabbing platform 48 on which drilling personnel can stand while conducting the stabbing procedure described further below.

Located below the rearward section 42 of the second transport trailer component 12 is a wheeled undercarriage 46 which carries a major portion of the weight at the rear end of the second transport trailer component 12. Located rear of the main frame of the second transport trailer component 12, and attached thereto is an auxiliary wheeled under carriage (FIG. 3), which is removable and used only during transport for load distribution to the surface over which travel is being made. Located at the very rear end of the mainframe of the second transport trailer component is a mast base 50 to which the bottom end of the mast 37 is pivotally connected by a pin connector 52. A hydraulic cylinder 51 is pivotally connected at one end to the frame of the trailer component 12 and at its other end to the mast 37, so that on expansion of the hydraulic cylinder 51, the mast 37 can be pivoted about the pin connection 52 from a horizontal transport position as shown in FIG. 3, to an upright working mode as shown in FIG. 1 in which position it can be fixed by the insertion of a locking pin in aligned holes in the lower part of the mast 37 and the mast base 50.

As previously indicated the tube injector 36 is carried at a desired location on the mast above the deck of the second transport trailer component. There may also be included at the base of the mast rotary table 53 (FIG. 1) and a top drive 54, connected by a cable 56 via a crown 55 at the top of the mast to a drawworks winch 57 mounted on intermediate section 41 of the second transport trailer component 12. A work platform 57 is provided in the area of mast base 50.

As will be described further below, when in operation, tubing 60 from the storage reel 26 passes over a gooseneck 61 before entering the tube injector 36. The gooseneck 61, which is attached at its base to the injector 36 and has a hinged outer portion 62. The outer portion 62 is connected to the injector 36 per se by a hydraulic cylinder 63, which when contracted pulls the gooseneck to a stored form so that as the mast 37 is lowered to a transport condition, in a contracted form, it fits into a depressed area formed in the intermediate section 41 of the second transport trailer component 12, thereby allowing the mast 37 to assume its horizontal transport mode of FIG. 3.

In operation of the system of the present invention, normally the second transport trailer component 12 would be pulled by the transport tractor 15*b* to a site where the well is to be drilled, and this component would be placed with the mast base 50 substantially located over the well centre for drilling. The outriggers 43 are deployed and the mast 37 is partially raised to a coil stabbing position shown in FIG. 4, and when the first transport trailer component 11 is brought to the site by the transport tractor 15*a*, it may be backed into the position shown in FIG. 4 with the forward section 24 of the second transport trailer component overlying the lower rearward section 21 of the first transport trailer component 11 so as to form a continuous upper deck of the thus formed rig. Outriggers at the front of component 11 (not shown) are then lowered to stabilize the front of the component 11, as the transport tractor 15*a* is removed, and the appropriate connections, including the hydraulic system which is common throughout the connected components 11 and 12, are performed. With the two components 11 and 12 appropriately aligned and positioned the hydraulic components of the control arm 35 can be positioned, tilted and extended, to bring the free end 31 of the tubing 60 held by the gripper box 34 to a position above the stabbing platform 45 so as to begin the stabbing process. Because the coiled tubing 60 on the reel 26, tends to unwind, the coil is maintained in tension as it is held by the gripper box 34. With the end 32 of the tubing held by the gripper box 34, it is connected end-to-end by an internal connector to a piece of tubing, herein termed a snake member or tubing snake 65 (FIG. 4), which is installed in place of the normal tubing into the tube injector 36. With the connection made, the gripper box is released as the injector is then used to prevent the tubing from unwinding off the storage reel. This is followed by the tube injector being energized so that tubing is run from the storage reel through the tube injector 36, and as the connection between the end 32 has passed through the injector the tubing snake 65 is removed. At this stage the mast may be raised to its working position of FIG. 1, and the hole drilling operation commenced. During feeding of the tubing through the tube injector 36, the storage reel is driven by its drive system 30, acting much like a mooring winch. The drive motor 31 is activated to pull coil from the storage reel when the tubing is being pushed into the hole by the tubing injector and pulling tubing from the tubing injector when the tube is being drawn out of the hole.

When the working operations with the coiled tubing is finalized, the mast 37 is returned to the position shown in FIG. 4 and the tubing snake 54 is again attached to the end of the free end 32 of the tubing 60 as it is pulled from the hole, the injector 36 then being operated to pass the snake until the free end 32 of the tubing approaches the area of the stabbing platform, and at which time the free end 32 of the tubing 60 is again clamped by the gripper box 34 and disconnected from the tubing snake 65, which may remain in the tube injector 36. At this time the first transport trailer component 11 may be disconnected in relation to the second transport trailer component 12 and pulled away from the second transport trailer component by transport tractor 15*a* and at which time the mast 37 may be further lowered to its transport mode on the second transport trailer component 12, as shown in FIG. 3.

It may be understood from the above that by utilizing the separate transport trailer components 11 and 12 as described above the coiled tubing injector system of the present system may be transported to the site with coiled tubing of a quantity which allows for much deeper drilling while exposing the roadways to acceptable load requirements. The storage reel can be made wider to carry more coiled tubing as there are less dimensional restrictions than with the single trailer designs now in use. Moreover, while the present invention requires stabbing and unstabbing the tubing when reaching and leaving a site, respectively, it is apparent from the above that the present invention provides for procedures which take acceptable time in relation to the significant advantages in the continuous drilling of the deeper holes. Because of the manner in which the two transport trailer components 11, 12 are arranged to form a continuous working coiled tubing injector system and in view of the provisions and location of elements, including the controllable gripper box 34 adjacent the stabbing platform, it can be appreciated that the set-up at a well site, stabbing of the well and the removal of the coiled tubing and complete withdrawal from the site can be carried out in a manner involving no significant procedural steps different with the now popular single component rigs. On the other hand the operation with the present invention effectively has the ability of drilling deeper wells as compared to such single component rigs.

While a single embodiment of the invention has been described variations within the spirit of the present invention as defined in the accompanying claims will be obvious to those skilled in the art.

The invention claimed is:

1. A coiled tubing injector system comprising first and second transport trailer components, each having a load supporting deck providing a forward section including a connector means for independent attachment to fifth wheels of a separate tractor unit;

said first transport trailer component including an intermediate section contiguous with said forward portion and providing support means for a tubing storage reel, and a rearward section contiguous with said intermediate section thereof for combining with said forward section of said second transport trailer component; and said second transport trailer component including an intermediate section contiguous with said forward section thereof and a rearward section contiguous with said intermediate section, said rearward section of said second transport component mounting a mast carrying a tube injector, said mast having a pivotal connection with said rearward section of said second transport trailer component for movement of said mast between a vertical position and a substantially horizontal position overlying said intermediate and forward sections of said second transport trailer component;

whereby on aligning said rearward section of said first transport trailer component with the forward section of said second trailer component in a mating relation at a drill site, a continuous coiled tubing injector rig is provided;

wherein said forward section and said intermediate sections of said first transport trailer component form a raised portion of said first transport trailer component in relation to a lowered portion thereof forming said rearward section of said first transport trailer component, and wherein said forward section of said second transport trailer component is formed by a raised portion of said second transport trailer component in relation to the intermediate and rearward sections thereof, whereby the forward section of said second transport trailer component overlies said rearward section of said first transport trailer component when said components are joined.

2. A coiled tubing injector system comprising:

first and second transport trailer components, each having a load supporting deck providing a forward section including a connector means for independent attachment to fifth wheels of a separate tractor unit;

said first transport trailer component including an intermediate section contiguous with said forward portion and providing support means for a tubing storage reel, and a rearward section contiguous with said intermediate section thereof for combining with said forward section of said second transport trailer component;

said second transport trailer component including an intermediate section contiguous with said forward section thereof and a rearward section contiguous with said intermediate section, said rearward section of said second transport component mounting a mast carrying a tube injector, said mast having a pivotal connection with said rearward section of said second transport trailer component for movement of said mast between a vertical position and a substantially horizontal position overlying said intermediate and forward sections of said second transport trailer component;

whereby on aligning said rearward section of said first transport trailer component with the forward section of said second trailer component in a mating relation at a drill site, a continuous coiled tubing injector rig is provided; and a gripper box carried on said supporting deck of said first transport trailer component rearwardly of said support means for said tubing storage reel and positioned to hold a free end of coiled tubing stored on said tubing storage reel.

3. A coiled tubing injector system as defined in claim 2, wherein said gripper box is attached to the first transport trailer component by a control arm for locating said gripper box above the load supporting deck of the first transport trailer component.

4. A coiled tubing injector system as defined in claim 3, wherein said control arm includes a double acting hydraulic cylinder controllable for elongating said control arm to thereby locate said free end of the coiled tubing at a desired height.

5. A coiled tubing injector system as defined in claim 4, wherein said control arm is pivotally connected at a lower end thereof to said first transport trailer component, and further comprising a second double acting hydraulic cylinder connected between said control arm and said first transport trailer component and being controllable for establishing the angle of pivot between the control arm and the first transport trailer component.

6. In a method of feeding a coiled tubing into and out of a well at a well-head site, comprising the steps of moving separate first and second transport trailer components to the site, wherein, said transport trailer components each have a rear portion, and a forward portion for overlying and attachment to a fifth wheel of a tractor unit, said first transport component further has an intermediate portion carrying a motor driven tubing storage reel for rotation about a transverse axis, and a gripping member rearwardly of said tubing storage reel for holding a free end of the tubing on said reel, said second transport component has a rear end portion, and a mast carrying a tube injector mounted on said rear end portion of said second transport component, said mast being pivotally connected to said rear end of said second transport component and including motor means for raising and lowering said mast between a lowered transport mode overlying said second transport component in said transport mode and an upright operational mode, a process including;

positioning the second transport component in a position with a rear portion over the well head site, backing the first transport component into alignment with the forward end portion of the positioned second transport component with said rear portion of said first transport component juxtaposed said forward portion of said second transport component to form a substantially continuous aligned upper deck of the aligned first and second transport components, releasing said gripping member to allow said free end of the stored coiled tubing to pass from said storage reel and to be drawn over a goose-neck of said injector by initially energizing said injector, raising said mast to an upright operating position, commencing a drilling operation while continuing to feed said tubing from said reel and through said injector and into said well.

7. In the method of claim 6, the process further including the steps of:

attaching to said free end of the stored coiled tubing a rear end of a snake member, prior to releasing said gripping member, a forward end of said snake member being at least partially passed through said injector;

operating said injector further after the releasing of said gripping member to draw said snake member completely therethrough whereby said free end of said stored coiled tubing is pulled over said gooseneck and enters said injector; and disconnecting and removing said rear end of said snake member from said free end of said coiled tubing.

8. In the method of claim 6, wherein the process further includes the following steps after completion of said drilling operation, withdrawing said tubing from the drilled well by reverse operation of said injector and recoiling said tubing on said storage reel, lowering said boom, clamping the free end of said coiled tubing by said griping member, and removing said first transport component from said site, and separately moving said second transport component from said site.

9. In the method of claim 8, the process further including the steps of;

terminating operations of said injector and the recoiling by said storage reel when the free end of the said tubing leaves the well, and before entering the injector, attaching to said free end of said tubing a forward end of a snake member, reactivating said operation of said injector and said storage reel to continue rewinding said tubing until said free end of said tubing approaches said clamping member, reactivating said gripping member to hold said free end of said tubing, and disconnecting said snake member from said free end of said tubing prior to removing said first and second transport components from said site.

* * * * *